US005176001A

United States Patent [19]

Taylor et al.

[11] Patent Number: 5,176,001

[45] Date of Patent: Jan. 5, 1993

[54] NESTED TUBE CRYOGENIC SUPPORT SYSTEM

[75] Inventors: Zachary R. Taylor; Fred J. Darms, Jr., both of Pomona, Calif.

[73] Assignee: Harsco Corporation, Wormleysburg, Pa.

[21] Appl. No.: 767,895

[22] Filed: Sep. 30, 1991

[51] Int. Cl.[5] ..... F17C 3/00

[52] U.S. Cl. ..... 62/45.1; 62/51.1; 248/317

[58] Field of Search ..... 62/45.1, 51.1; 248/317

[56] References Cited

U.S. PATENT DOCUMENTS

| | | | |
|---|---|---|---|
| 3,814,361 | 6/1974 | Garbon et al. | 248/146 |
| 4,291,541 | 9/1981 | Kneip, Jr. et al. | 62/51.1 |
| 4,325,530 | 4/1982 | Niemann et al. | 248/317 |
| 4,491,347 | 1/1985 | Gustafson | 285/47 |
| 4,696,169 | 9/1987 | Niemann et al. | 62/514 |
| 4,781,034 | 11/1988 | Nicol et al. | 62/514 |
| 4,878,351 | 11/1989 | Weber et al. | 62/51.1 |

OTHER PUBLICATIONS

"Energy Saver Cryostat Support Material Creep Measurements" by F. Markley, Fermilab, Jan. 1984.

"Cryogenic Support Thermal Performance Measurements" by J. D. Gonczy, W. N. Boroski, T. H. Nicol, R. C. Niemann, J. G. Otavka, & M. K. Ruschman, Fermilab.

*Primary Examiner*—Ronald C. Capossela

*Attorney, Agent, or Firm*—Kerkam, Stowell, Kondracki & Clarke

[57] ABSTRACT

An improved nested tube cryogenic support and its method of manufacture includes a plurality of nested tube assemblies each including an FRP tube having a metal connector element integrally joined at each end thereof by forming a groove around the outer periphery of the connector elements, forming the end portion of the uncured FRP tube into the groove, and applying a prestressed fiber reinforced plastic band around the outer periphery of the tube at the groove to apply a compressive force reinforcing the joint between the connector elements and the tube.

18 Claims, 2 Drawing Sheets

FIG. 3
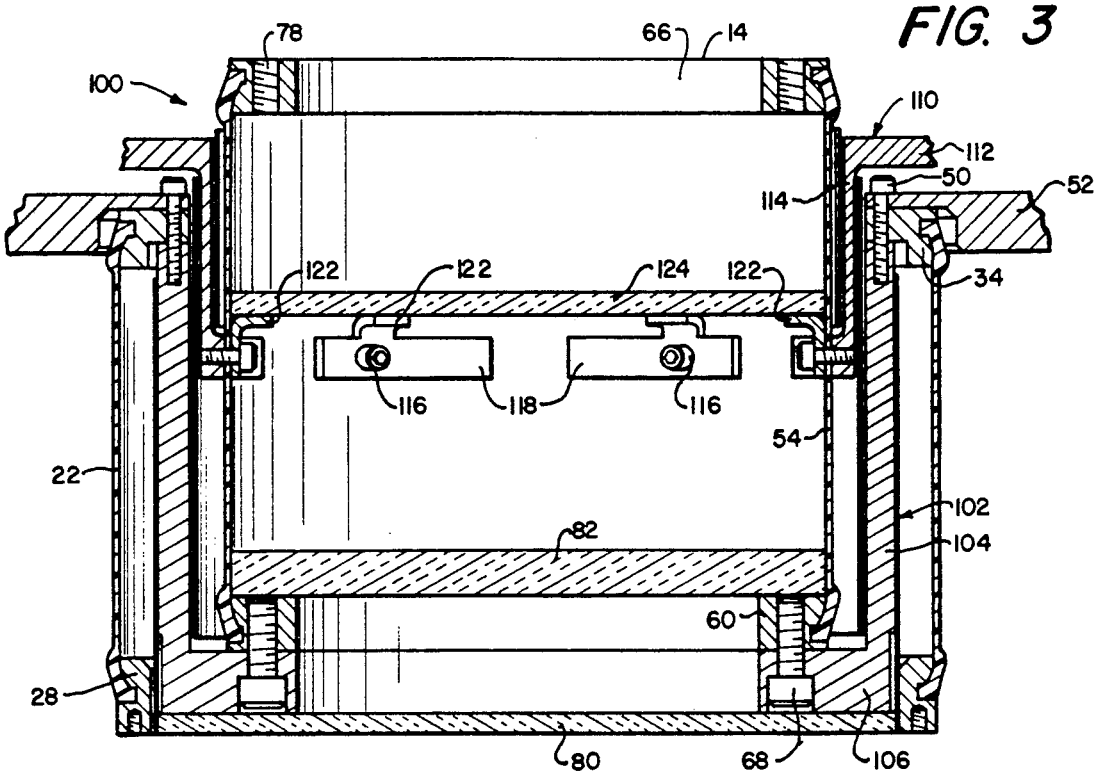
FIG. 4
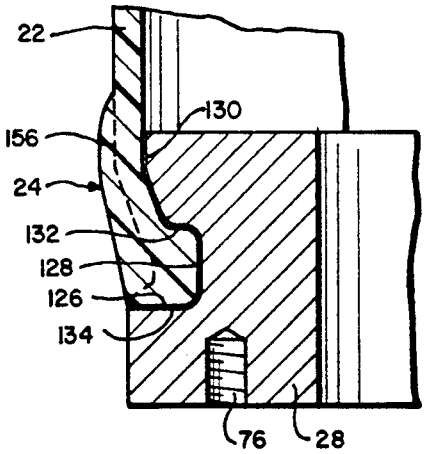
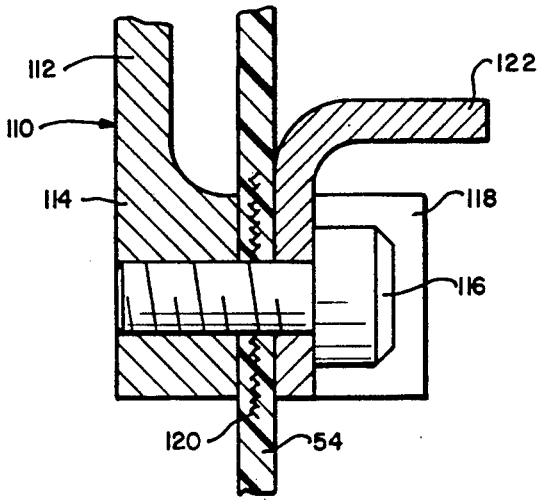
FIG. 5

NESTED TUBE CRYOGENIC SUPPORT SYSTEM

BACKGROUND OF THE INVENTION

This invention relates to cryogenic supports and more particularly to improved tubular cryogenic supports of the type including a fiber reinforced plastic tubular structural member having metal end fittings integrally joined thereto, and to an improved method of forming such supports.

Cryogenic technology and its use both in scientific experimentation and commercial applications has met widespread growth in recent years. This growth has been accompanied by a need for the development of materials and structures capable of operating over sustained periods in a cryogenic environment, and of being subjected to repeated cycling between ambient and cryogenic temperature. For example, there has developed a need for improved structures for supporting apparatus operating in a cryogenic environment from a base or foundation at ambient temperature, which support structure minimizes the transfer of heat between the two environments.

Compact cryogenic supports, sometimes referred to as re-entrant supports or nested tube support assemblies, have been developed and generally are recognized as the ideal type of suspension structure for superconducting magnets. These assemblies comprise a number of tubes of different diameters which, when nested and fastened inside one another, form an essentially long tubular support providing a long heat flow path through the tubular members as compared to the relatively short overall length of the nested assembly. This extended heat flow path, in combination with the use of heat sinks or heat intercepts along the length of the flow path, provides for minimum heat flow to the superconducting magnets maintained at cryogenic temperature.

A nested tube cryogenic support developed specifically for use in connection with the Superconducting Super Collider (SSC) is disclosed in U.S. Pat. No. 4,696,169 ('169) and an improved means for providing lateral stability to such support systems, along the length of the SSC, is disclosed in U.S. Pat. No. 4,781,034 ('034). The present invention is an improvement over the cryogenic support system disclosed in the '169 patent and the disclosure of the cryogenic support member contained in this patent is incorporated herein by reference. For a more complete understanding of the manner of use of such cryogenic support system in the SSC environment, reference is specifically made to the '034 patent.

As is explained in the '169 patent, one of the principal obstacles in providing a cryogenic support system of the type employing a fiber reinforced plastic (FRP) tubular member having metallic end connectors is the difficulty in providing a joint between the FRP tube and the metal connectors which will withstand the repeated severe mechanical and thermal stresses imposed in a cryogenic atmosphere such as encountered in the SSC. In accordance with the '169 patent, a rigid mechanical joint is provided by a heat shrinking operation wherein the FRP tube is clamped between an internal metallic disc and flange. The high friction clamping joint is provided by cooling the internal disc to a cryogenic temperature and inserting it into the end of the FRP tube. The external band is located and telescoped onto the outer end of the tube in radial opposition to the disc and the temperature of the assembly is permitted to stabilize so that the internal disc expands and the external ring contracts to firmly clamp the FRP tube therebetween. In practice, the internal disc has been cooled to approximately −320° F., the FRP tube is at ambient temperature, and the external band heated to approximately 275° F. for assembly.

While a shrink fit connection between the FRP tube and the metal connectors as disclosed in the '169 patent provides a strong and reliable high friction joint, such an arrangement is not entirely satisfactory for several reasons. For example, extremely close tolerances must be maintained between all of the interfitting components, which greatly increases the overall cost of the structure. Further, the FRP tube is conventionally formed by a winding operation wherein the tube is built up from a fiber reinforced plastic, typically fiberglass and epoxy, and the as-wound dimensions and surface smoothness of the tube generally cannot be maintained at the extremely close tolerances required. This thus required the tube to be refinished, externally, by a grinding operation to provide the desired surface characteristics and dimensional tolerances. The grinding operation inherently severs and exposes the reinforcing fibers in the FRP tube tending to weaken the structure. Further, assembling the structure under the exacting conditions required by the temperatures involved necessarily increase the cost of the structure.

The metal connector elements employed in the shrink fit joint of the '169 patent inherently requires a substantial mass of metal both internally and externally of the FRP tube at each joint. The metal connectors also require a substantial difference in diameter between the nested tube elements and inherently place certain restrictions on the structure and performance of the assembly, including the location of the heat intercepts employed to restrict the transfer of heat along the length of the FRP tube.

The primary object of the present invention is therefore to provide an improved nested tube cryogenic support assembly, and a method for its production, which avoids the above and other disadvantages of the prior art nested tube supports.

Another object of the invention is to provide such a cryogenic support with enhanced thermal performance without the sacrifice of structural integrity.

Another object is to provide such a cryogenic support which will not require machining or grinding of cylindrical surfaces of the fiber reinforced tubular elements and which will eliminate the necessity for close dimensional tolerances required by prior art supports.

Another object is to provide such a cryogenic support which will require a minimum of parts and which can be economically produced.

Another object is to provide such a support, and its method of manufacture, wherein the FRP tube and its metal connector elements are integrally joined during winding of the FRP tube.

Another object is to provide such a support, and its method of manufacture, wherein the metal connector elements have an external diameter which does not materially exceed the outside diameter of the FRP tube to which it is integrally connected.

Another object is to provide such a support, and its method of manufacture, which enables utilization of an increased overall length of FRP tubing without increasing the height of the support.

Another object is to provide such a support and its method of manufacture which enables the use of a plurality of concentric FRP tubes to define the heat flow path between the ambient temperature connector element and the minimum temperature connector element.

In the attainment of the foregoing and other objects and advantages of the present invention, an important feature resides in forming each of the FRP tubes and its associated metal connector elements as an integrally joined assembly by supporting the connector elements in spaced coaxial relation and forming the FRP tube with its end portions overlapping the outer periphery of the connector elements. Each connector element has an annular groove formed around its outer periphery and the end portions of the FRP tube are formed into the annular groove and cured to form a rigid integral joint. The joint is reinforced by winding a reinforcing band of a plastic impregnated fiberglass material under a high tensile load over the outer surface of the FRP tube in the area of the connector element. The prestressed reinforcing band is cured so that the tensile stress in the reinforcing fibers applies a compressive load to the FRP tube between the reinforcing band and the opposed groove surface of the connector element.

In forming the integrally joined tube and connector element assemblies, preferably a plurality of pairs of metal connector elements are supported on an elongated mandrel and a single FRP sleeve is wound over all of the plurality of pairs of connector elements. After winding, the FRP sleeve is cut to the proper lengths for each FRP tube, for example, by bringing a cutter element into contact with the rotating outer surface of the sleeve on the mandrel. The cut ends of the respective FRP tubes are then formed into the underlying annular grooves in the associated connector elements before the FRP tube element is cured so that an integral bond is formed.

A plastic reinforced fiberglass strand is then wound, under a predetermined tensile load, over the outer surface of the end portion of each FRP tube outboard of the respective connector elements to form a prestressed band applying a compressive force or load to the joints between the FRP tube and the respective connector elements. The band and tube are then finally cured so that the band becomes an integral part of the FRP tube while maintaining the desired compressive load which reinforces the integral bonded surface-to-surface contact between the FRP tube and the respective connector elements throughout the repeated temperature changes which may be encountered in such cryogenic supports.

BRIEF DESCRIPTION OF THE DRAWINGS

Other features and advantages of the invention will be apparent from the detailed description of the invention contained hereinbelow, taken in conjunction with the drawings, in which:

FIG. 3 is a sectional view, similar to FIG. 2, of an alternate embodiment of the invention;

FIG. 4 is an enlarged fragmentary sectional view of a portion of the structure shown in FIG. 3; and FIG. 5 is an enlarged fragmentary sectional view of another portion of the structure shown in FIG. 3.

DESCRIPTION OF THE PREFERRED EMBODIMENTS

Figure 1:
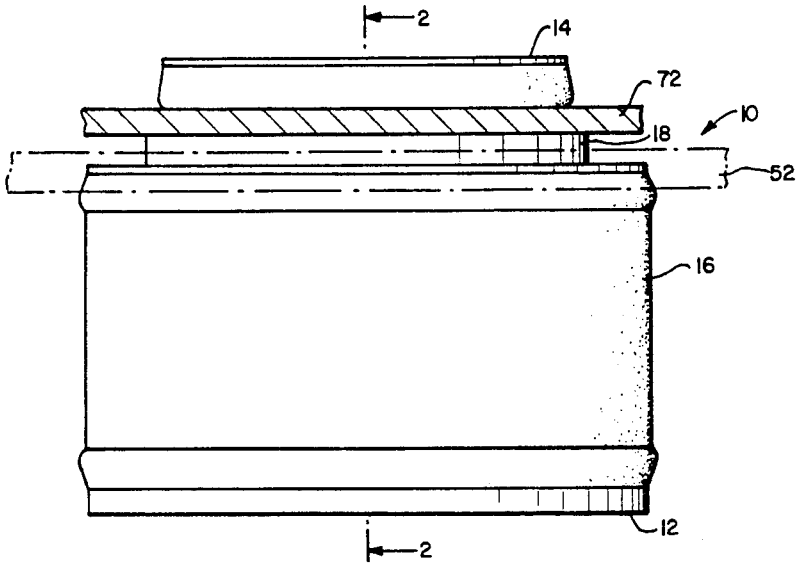
FIG. 1 is an elevation view of a cryogenic support embodying the present invention.
Figure 2:
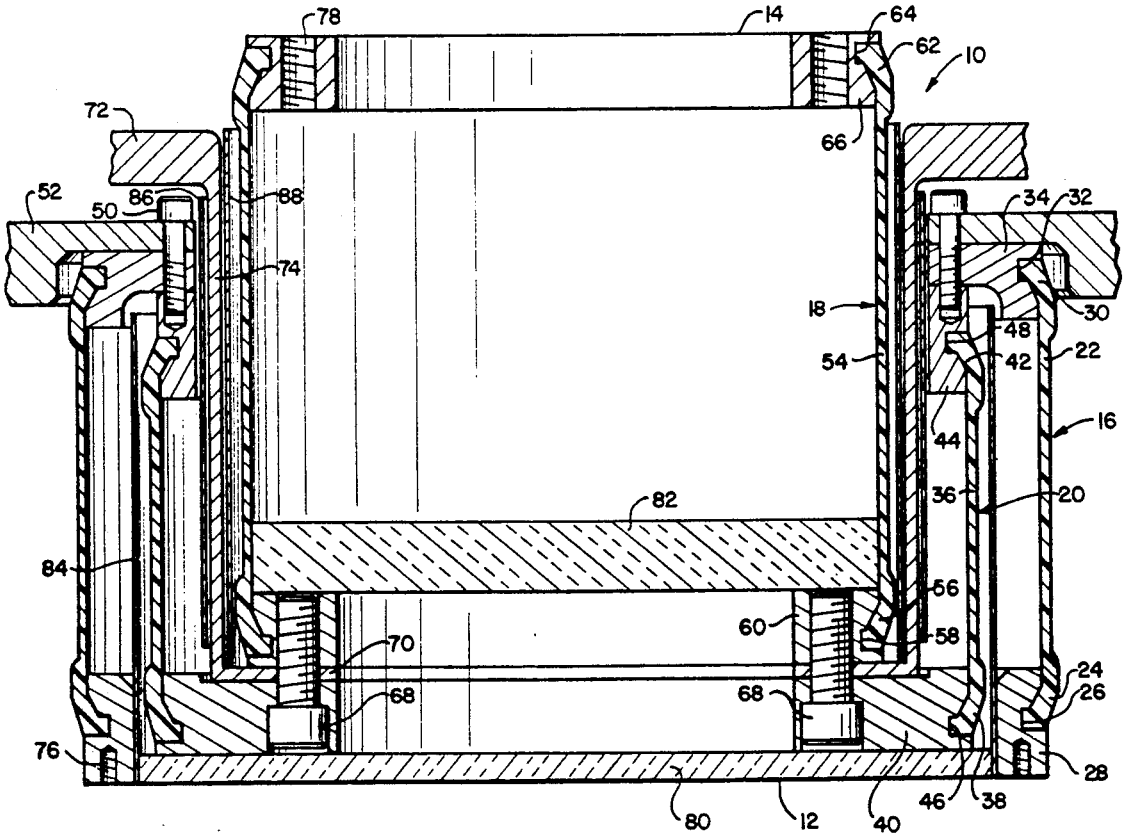
FIG. 2 is an enlarged sectional view taken along line 2—2 of FIG. 1.

Referring now to the drawings in detail, a folded tube cryogenic support embodying the present invention is indicated generally by the reference number 10 in FIG. 1, and is adapted to be mounted at its base 12 on a suitable structural foundation or support (not shown) and to support a cryogenic mass (not shown) on its top surface 14. As best seen in FIG. 2, a typical embodiment of the invention comprises an outer cylindrical tubular assembly 16, an inner cylindrical tubular assembly 18, and an intermediate cylindrical tubular assembly 20 rigidly connecting the outer and inner assemblies 16, 18.

The outer tubular assembly 16 comprises an FRP structural tube 22 having an inwardly directed, thickened portion 24 formed into an outwardly directed annular groove 26 in a bottom annular connecting element 28, and a second thickened end portion 30 formed into an outwardly directed annular groove 32 in a top annular metallic connecting element 34.

The intermediate tubular assembly 20 also includes a FRP structural tube 36 integrally joined at its bottom end 38 to an annular metal connector element 40 and at its top end 42 to annular metal connector element 44. A contoured annular groove 46 is formed around the outer periphery of metal connector element 40 and the bottom end 38 of tube 36 has a shape complementary to and fitted within groove 46. Similarly, metal connector element 44 has a contoured annular groove 48 extending around its outer periphery and top end portion 42 of tube 36 is shaped complementary to and fitted within groove 48.

Metal connector element 34 overlies and is joined to metal connector element 44 by suitable means such as threaded fasteners or bolts 50 to support tubular assembly 20 concentrically within tubular assembly 16. Bolts 50 may also be employed to connect a metallic heat intercept ring or body 52 into direct heat exchange contact with the metallic connector element 34 as clearly seen in FIG. 2. In practice, all the metallic connector elements employed in the support may be formed from a high strength metal material such as 316 stainless steel while heat intercept member 52 preferably is formed from a metal such as copper or aluminum having a high capacity to conduct heat.

Still referring to FIG. 2, the inner cylindrical tubular assembly 18 also includes a FRP structural tube 54 having its lower contoured end portion 56 fitted within a complementary outwardly directed annular groove 58 extending around the outer periphery of metal connector 60 and the top end 62 of tube 54 is fitted within a complementary annular groove 64 in metallic connector element 66.

Connector element 60 is mounted on and rigidly connected to connector element 40 by suitable means such as threaded fasteners or bolts 68. An inwardly directed flange 70 on a second heat intercept 72 is positioned between and in heat exchange contact with connector elements 60 and 40, with a cylindrical portion 72 of heat intercept 70 extending coaxially with and between tubular assemblies 18 and 20. As shown, the principal metallic mass of heat intercept 70 may be located near the top portion of the inner tubular assembly 18, enabling the use of longer structural tube members 32 and 36 where desired to provide a longer heat flow path through the support assembly.

In practice, structural tubes 32 and 36 may be of a length to position heat intercept 52 in close proximity to heat intercept 70. Since the heat transfer from the base 12 to the top 14 of the support is inversely proportional to the length of the heat flow path through the structure, it is generally desirable from the standpoint of thermal efficiency to maximize the length of the low conductivity FRP tube. Conversely, stresses applied to the structure as a result of lateral, or bending loads will increase in proportion to the length of this heat flow path, placing practical limits on the total length of the FRP tubing which may be used. At the same time, where space limitations are not critical, the diameter of the tubing can be increased to provide increased strength, and stiffness as required.

In order to eliminate or minimize heat transfer within the support assembly by radiation, multi-layer insulation is employed. For example, a stack 80 of thin layers or discs of insulating material fills the end of connector element 28 at the base of the support to eliminate heat radiation from the foundation structure. A second multi-layer stack 82 of such insulating material is fitted within the interior of FRP tube 54 at the inner end of metal connector element 60. Layers of thin insulating material are also wound upon the outer periphery of internal cylindrical components as shown schematically by the layers 84, 86 and 88, respectively, extending around and covering the outer periphery of intermediate tube assembly 20, the outer surface of the cylindrical body portion 74 of heat intercept 72 and the outer cylindrical surface of inner tubular assembly 18. The use of such insulating material in this environment is known and has been used, for example, in connection with the cryogenic support disclosed in the '169 patent.

When used in the SSC environment, the support assembly 10 will be mounted to a base by suitable means such as welding or by threaded fasteners extending into the threaded bores 76, with the base being at ambient temperature or about 300° K. (the 300° K. station). The temperature at the heat intercept 52 will be approximately 80° K. (the 80° K. station) while the temperature at the heat intercept 72, i.e., at its contact point with the metal connector element 60, will be approximately 20° K. (the 20° K. station). The cold mass of the SSC will be supported on the metal connector element 66 by suitable means such as bolts extending into threaded bores 78. The temperature at this location will be approximately 4.5° K. (the 4.5° K. station).

Referring now to FIG. 3, an alternate embodiment of the cryogenic support, indicated generally by the reference numeral 100, will be described. In this embodiment, the outer cylindrical tubular assembly 16 and the inner cylindrical tubular assembly 20, and certain other elements are identical to those described above with reference to FIG. 2 and in the interest of brevity these elements will not be again described but rather like reference numerals will be used to designate common elements of the two embodiments.

In the embodiment of FIG. 3, a shaped metallic member 102 is substituted for the intermediate cylindrical tubular assembly of the preceding embodiment. Member 102 includes a cylindrical body 104 having its top end rigidly joined by the bolts 50 to the connector element 34 and heat intercept 52. At its bottom end, element 102 includes an inwardly directed flange 106 which is rigidly joined to and supports connector element 60, with bolts 68 providing a rigid connection therebetween. The element 102 is preferably formed from a high strength metal and provides a rigid connection directly between connector elements 34 and 60, thereby providing increased strength and rigidity to the overall cryogenic support assembly. This increased strength is achieved at the sacrifice of reduced thermal efficiency, however, over the embodiment shown in FIG. 2 because of the higher thermal conductivity of member 102.

An alternate arrangement of the heat intercept at the 20° K. station is also illustrated in FIG. 3. In this arrangement, a heat intercept member 108 has an annular radially extending body portion 110, a cylindrical segment 112 extending downwardly along the outer surface of FRP tube 54 and a thickened ring portion 114 in contact with the outer surface of FRP tube 54 at a location intermediate its ends. Vertical slits 117 in the cylindrical segment 112 allow radial flexure of the thickened ring portion 114 for installation and attachment to the FRP tube 54. Bolts 116 extend through clamp members or brackets 118 located within and in direct contact with the inner surface of FRP tube 54 and into threaded apertures in the ring portion 114 to support the heat intercept 108 in direct heat exchange contact with the FRP tube.

In FIG. 3, the clamping brackets 118 and bolts 116 are schematically illustrated as being located on approximately 60° centers around FRP tube 54, with a single bolt 116 extending through each clamping bracket. It should be apparent, however, that a plurality of such bolts may be employed in each clamping bracket and that the radial positioning of such brackets may be varied as necessary to provide continuous heat exchange contact between the heat intercept ring portion 114 and the outer surface of the FRP tube. Although a single continuous ring-shaped clamping member could be employed, the use of multiple clamping brackets permits greater tolerances in the internal dimension of the FRP tube. Also, to facilitate heat transfer from the FRP tube to the heat intercept, it is preferred that a metallic element, for example, a copper screen or mesh 120, be wound into the FRP tube 54 in the area in contact with the ring portion 114 of the heat intercept as shown in FIG. 5. The use of such embedded metallic members to facilitate heat transfer is shown in U.S. Pat. No. 4,325,530.

Each clamping bracket 118 may be provided with a radially inwardly extending insulation supporting arm 122 for supporting a multi-layer insulation pad 124. This arrangement effectively moves the 20° K. station to the position along FRP tube 54 contacted by the heat intercept 110.

It should be apparent that, in the embodiment of FIG. 3, the heat intercept 110 may be located to contact FRP tube 54 at any desired location along its axial length since the cylindrical body portion 112 of the heat intercept may be dimensioned to project into the space between FRP tube 54 and metallic member 102. Also, when the heat intercept projects into this space, the wound insulation layer may be supported on portion 112. Similarly, it is apparent that heat intercept 110 may be located in close proximity to heat intercept 52 either by extending the length of FRP tube 22 and metal member 102 or by moving heat intercept 112 axially downward. In the latter arrangement, additional heat intercepts similar to that just described may be employed to further enhance the thermal efficiency of this cryogenic support.

FIG. 4 is an enlarged fragmentary sectional view illustrating the integral connection between metallic connector 28 and the enlarged end section 24 of the FRP tube 22. This connection is typical of the joints between each metal connector element and its associated FRP tube and the description with reference to FIG. 4 may be applied to each such connection. Thus, the annular groove formed in the outer periphery of the metal connector element defines an axially directed shoulder 126, a generally axially extending trough portion 128 and an outwardly convex transition portion 130. Transition portion 130 includes a shoulder or abutment portion 132 at its juncture with the trough 128. Also, a thin layer 134 of adhesive material may be applied to and coat the surface of the groove to enhance the bond between the metallic connector 28 and the portion of the FRP tube in contact therewith. The use of the adhesive layer 134 may depend upon the type of plastic material, or epoxy employed in the FRP tube and may be omitted where not required for adequate bonding.

The FRP tubing and metallic connector elements may be integrally joined by winding the fiber reinforced plastic material on the outer surface of a mandrel. The assembled metallic support members and mandrel may be mounted in a commercial winding apparatus where a continuous fiber reinforced plastic cylinder of uniform thickness and construction is wound over the outer cylindrical portion of the assembly. Conventional winding practices for the application of axial or spiral as well as circumferential fibers is employed.

Upon completion of the winding operation, the end portions of tube 22 are formed into the underlying, outwardly directed grooves in the metal connector elements as shown in FIG. 4. In forming the ends of the FRP tube into the groove, care is taken to completely fill the groove so as to provide a continuous bond between the fiber reinforced plastic material and the metal surface. Care is also taken during this forming step not to excessively disrupt the orientation of the fibers or to excessively express the plastic material from the fibers and thereby weaken the joint.

After the FRP tubing ends are formed into the grooves, a strand of fiberglass reinforced plastic material is wound onto each end portion of the FRP tube 22 to reinforce the joint between the FRP tube and the metal connector, again using known winding techniques. The strand is wound under substantial tension, building up a reinforcing band on the outer circumference of the FRP tube at each end. The hoop tension load in the band applies a compressive load between the band and the underlying metal connector element to reinforce the bond. The band and tube are then cured so that the band becomes an integral part of the thickened end portion 24 of the FRP tube 22, with the portion of the enlarged section 24 of FRP tube 22 outboard of the broken line 136 in FIG. 4 schematically illustrating the tensile band. The assembled tube and reinforcing band are then cured to form an integral unit rigidly joined to the metallic support member.

While preferred embodiments of the invention have been disclosed and described in detail, it should be apparent that the invention is not so limited and it is intended to include all embodiments thereof which would be apparent to one skilled in the art and which come within the spirit and scope of the invention.

What is claimed is:

1. A cryogenic support including at least one generally cylindrical structural assembly comprising a tubular member formed of a fiber reinforced plastic material having a low thermal conductivity and a pair of metal connector members rigidly mounted one on each end of said tubular member, said connector members each including an annular outer surface portion having an annular groove formed therein, said groove being defined by a shoulder abutting one end of said tubular member, a trough portion adjacent to and extending from said shoulder axially inward of said tubular member, and an outwardly convex transition portion extending axially inward of said tubular member from said trough portion and including a first section having a relatively short radius of curvature and a second section having a substantially longer radius of curvature, said first section being located adjacent to said trough portion and cooperating therewith to provide an axial abutment resisting relative axial movement between said tubular member and said connector member, said tubular member including an annular contoured inner surface at each end thereof complementary to and fitted within said annular groove in said connector member mounted thereon, and a plastic impregnated prestressed fiber reinforcing band extending around the outer surface of said tubular member at least in the area radially outward of said contoured surface portion, said reinforcing band being bonded to and forming an integral part of said tubular member and being under a hoop tensile load applying a compressive load between said connector member and said tubular member.

2. The cryogenic support defined in claim 1, further comprising a layer of adhesive within each said groove rigidly bonding said contoured surface portion of said tubular member to the surface of said groove in each said connector member.

3. The cryogenic support defined in claim 1 wherein said reinforcing band comprises an epoxy impregnated fiber reinforcing element wound onto the outer surface of said tubular member under a predetermined tensile load.

4. The cryogenic support defined in claim 1 comprising first and second said generally cylindrical structural assemblies, said second generally cylindrical structural assembly having a smaller diameter and having one end disposed within and adjacent one end of said first generally cylindrical structural assembly and its other end projecting outwardly from the other end of said first generally cylindrical structural assembly, and mounting means within said first generally cylindrical structural assembly joining the metal connector member at said one end of said second generally cylindrical structural assembly to said metal connector member on said other end of said first generally cylindrical structural member.

5. The cryogenic support defined in claim 4 further comprising heat intercept means mounted on and in heat exchange contact with the outer surface of said tubular member of said first generally cylindrical structural assembly at a location intermediate said pair of metal connector members mounted thereon.

6. The cryogenic support defined in claim 5 further comprising heat intercept means mounted on and in heat exchange contact with the outer surface of said tubular member of said second generally cylindrical structural assembly at a location intermediate said pair of metal connector members mounted therein.

7. The cryogenic support defined in claim 5 further comprising metallic means integrally wound into said tubular member of said first generally cylindrical structural assembly, said metallic means forming a heat sink to facilitate heat transfer to said heat intercept means.

8. The cryogenic support defined in claim 4 wherein said mounting means within said first generally cylindrical structural assembly comprises an elongated generally cylindrical metal member disposed between said first and second generally cylindrical structural assemblies.

9. The cryogenic support defined in claim 4 wherein said mounting means within said first generally cylindrical structural assembly comprises a third said generally cylindrical structural assembly, said third generally cylindrical structural member having a diameter intermediate the diameter of said first and said second generally cylindrical structural assemblies.

10. The cryogenic support defined in claim 9 further comprising heat intercept means mounted on and in heat exchange contact with the outer surface of said tubular member of said first and said second generally cylindrical structural assemblies at a location intermediate said pair of metal connector members mounted thereon.

11. The cryogenic support defined in claim 10 further comprising metallic means integrally wound into said tubular member of said first generally cylindrical structural assembly, said metallic forming a heat sink to facilitate heat transfer to said heat intercept means.

12. The cryogenic support defined in claim 11 wherein said mounting means within said first generally cylindrical structural assembly comprises an elongated generally cylindrical metal member disposed between said first and second generally cylindrical structural assemblies.

13. A folded tube cryogenic support including first and second elongated generally cylindrical structural assemblies each having first and second ends and each comprising a tubular member formed of a fiber reinforced plastic material having a low thermal conductivity and a metal connector member rigidly mounted on said first and said second ends thereof, said second generally cylindrical structural assembly being of a smaller diameter and having its first end located within said first structural assembly and in proximity to the first end thereof, said connector members each including an annular outer surface portion having an annular groove formed therein, said groove being defined by a shoulder abutting one end of said tubular member, a trough portion adjacent to and extending from said shoulder axially inward of said tubular member, and an outwardly convex transition portion extending axially inward of said tubular member from said trough portion, said tubular member including an annular contoured inner surface at each end thereof complementary to and fitted within said annular groove in said connector member mounted thereon, a plastic impregnated prestressed fiber reinforcing band extending around the outer surface of said tubular member at least in the area radially outward of said contoured surface portion, said reinforcing band being bonded to and forming an integral part of said tubular member and being under a hoop tensile load applying a compressive load between said connector member and said tubular member, and mounting means within said first generally cylindrical structural assembly mounting the first end of said second generally cylindrical structural assembly to the second end of said first generally cylindrical structural assembly.

14. The cryogenic support defined in claim 13 wherein said transition portion on each said metal connector member comprises a first section having a relatively short radius of curvature and a second section having a substantially longer radius of curvature, said first section being located adjacent to said trough portion and cooperating therewith to provide an axial abutment resisting relative axial movement between said tubular member and said connector member.

15. The cryogenic support defined in claim 14 wherein said mounting means comprises a third said generally cylindrical structural assembly, said third generally cylindrical structural assembly being disposed between and coaxially with said first and second generally cylindrical structural assemblies and having the metal connector member on its first end connected to the metal connector member on the first end of said second generally cylindrical structural assembly and the metal connector member on its second end connected to the metal connector member on the second end of the first generally cylindrical structural assembly.

16. The cryogenic support defined in claim 15 further comprising heat intercept means mounted on and in heat exchange contact with the outer surface of said tubular member of said first generally cylindrical structural assembly at a location intermediate said pair of metal connector members mounted thereon.

17. The cryogenic support defined in claim 16 further comprising metallic means integrally wound into said tubular member of said first generally cylindrical structural assembly, said metallic means forming a heat sink to facilitate heat transfer to said heat intercept means.

18. The cryogenic support defined in claim 15 wherein said mounting means within said first generally cylindrical structural assembly comprises an elongated generally cylindrical metal member disposed between said first and second generally cylindrical structural assemblies.

* * * * *